United States Patent [19]

De Walt

[11] 4,036,670

[45] July 19, 1977

[54] TOOL STEEL

[75] Inventor: Maurice P. De Walt, New Kensington, Pa.

[73] Assignee: Continental Copper & Steel Industries, Inc., New York, N.Y.

[21] Appl. No.: 564,953

[22] Filed: Apr. 3, 1975

[51] Int. Cl.[2] ..... C21D 7/14; C21D 9/22

[52] U.S. Cl. ..... 148/12.1

[58] Field of Search ..... 148/12.1, 39, 14; 29/196, 196.2

[56] References Cited

U.S. PATENT DOCUMENTS

| | | | |
|---|---|---|---|
| 1,127,072 | 2/1915 | Morse | 148/12.1 |
| 3,031,330 | 4/1962 | Hornick et al. | 29/196.2 |
| 3,344,817 | 10/1967 | Connard | 148/12.1 |
| 3,527,624 | 9/1970 | Biretta et al. | 148/14 |
| 3,850,699 | 11/1974 | Gierek et al. | 29/196.2 |
| 3,959,028 | 5/1976 | Jackson | 148/11.5 R |

*Primary Examiner*—W. Stallard

*Attorney, Agent, or Firm*—Arthur A. March

[57] ABSTRACT

Reduced decarburization production of steel by providing a metallized, e.g., aluminized, adherent removable protective surface coating on the exterior of the steel workpiece prior to heating for hot-working and/or annealing, e.g., of the semi-finished billet, and metallized coating products thereby fabricated.

12 Claims, No Drawings

TOOL STEEL

The present invention relates to and has among its objectives the production of steel, elimination or reduction of decarburizaion and more particularly concerns the efficient and economical elimination of decarburization during heating of the steel by providing an inherent temporary protective surface coating of metal material such as aluminum applied to its exterior prior to such heating for working and annealing.

While the invention is applicable in the production of all steel having decarburization problems, hereinafter solely to facilitate an understanding of the invention, it will be described in connection with the production of tool steel. It is to be understood that this description is in no way to be considered a limitation upon the invention which, as aforesaid, is pertinent to all steel in whose production decarburization is a problem.

An inherent result of heating steel to form semi-finished or finished products is that some of the surface carbon content of the ingot, bloom, slab, billet, bar, preforms etc. being worked is lost by oxidation due to the surrounding atmosphere. For example, in the instance of tool steel, especially high speed steel, this loss of surface carbon or decarburization is a significant problem since it represents a corresponding decrease in usable tool steel yield and a concomitant waste of energy at a time when energy conservation is of recognized importance.

In the fabrication of tool steel products, steel formulation melts such as those produced in conventional electric arc furnaces are tapped into ladles and teemed or poured into molds of selective size to cast ingots. Each heat of ingots contains a specified carbon content as well as other alloying constituents corresponding to the properties desired in the finished tool steel product. After being stripped from their molds, the ingots are heated and subjected to a series of hot working and annealing manipulations to provide selectively shaped and sized tool steel products which may then be finally thermally treated as desired.

Tool steel ingots and/or billets are also made by powdered metallurgy process with similar alloying elements including carbon and are fabricated into semi-finished and finished products similar to the cast ingot product with similar problems of decarburization.

Therefore, all references to cast products are equally applicable to powdered techniques and such references are used for convenience only.

For instance, the cast ingot is conventionally heated to its hot-working temperature, to permit it to undergo permanent deformation by the application of mechanical forces to its surface, so as to obtain products of specific size and shape often with improved physical and mechanical properties. However, these hot working manipulations such as hot pressing or hammering or blooming the ingot into billet form, hot rolling the billet into a reduced size workpiece, and finally hot rolling the workpiece into a semi-finished workpiece, followed by annealing and/or heat treatment, all expose the workpiece to significant loss of surface carbon.

Consequently, after each of these heating cycle manipulations, the outer periphery of the workpiece becomes decarburized to some extent. To achieve a tool steel product free of decarburization, the workpiece is usually ground after each hot working operation to a sufficient depth to remove surface defects and the decarburized zones or areas.

After annealing, the workpiece, e.g., in bar form, is usually straightened by rolling on straightening rollers and then subjected to final cold finishing operations such as peeling and/or centerless grinding to remove surface defects and decarburization, if present. The finished workpiece or tool steel product thus represents only a part of the original quantity of tool steel, often amounting to yields of only about 50% by weight based on the starting melt.

Experience in particular with the fabrication of hot rolled bar and like products of tool steel, especially high speed steels, indicates that loss of surface carbon where it can adversely affect the quality of the finished product, occurs mainly at two stages of the processing, namely during billet heating for final rolling and during the final annealing cycle. Tool steel manufacturers over the years have attempted to reduce the amount of decarburization by various means. Protective coatings have been used to try to solve the problem but due to their drawbacks in practice, satisfactory performance at low cost has not been achieved.

Specifically, one practice involved the use of borax compound to coat billets by dipping and brushing before hot rolling. This expedient was fairly successful in protecting the workpiece against decarburization during heating for rolling; however, it did not provide any protection during annealing. Besides, the borax stop-off coating made the billets very slippery to handle during rolling operations and this presented an unnecessarily dangerous situation for the mill personnel.

Recently, other types of protective coatings and stop-off materials have been utilized with some degree of success including graphite, ceramic type and metal-base paint coatings. However, none of these coatings provide sufficiently effective surface protection against decarburization both during billet heating for rolling or during annealing.

A more drastic alternative adopted by some tool steel manufacturers has been the abandonment of those tool steel manipulative steps designed to reduce decarburization in favor of controlled atmosphere or vacuum annealing furnace installations. Large capital expenditures have been made for controlled atmosphere furnaces for the reheating and hot working of the tool steel workpieces and for vacuum annealing furnaces and the like, which because of their controlled ambient environments achieve the desired reduction of decarburization. The obvious drawback of these processing systems is their high capital investment for specific equipment and subsequent operating costs.

As a consequence, in connection with present day tool steel manufacture, either protective coatings or stop-off treatments or high cost apparatus installations are employed, which entail the above-noted shortcomings, or conventional heating techniques are utilized, without any special decarburization minimizing precautions, and relying on final cold finishing operations such as those involving peeling and/or centerless grinding to remove resulting decarburization, despite their offsetting overall low yields.

According to the present invention, an efficient and economical process for heating of tool steel substantially protected against attendant decarburization during such heating is provided. In its broad aspects, such process comprises applying an adherent removable protective surface coating of metal material onto the exterior of the tool steel workpiece to be heated, carrying out such heating of the protected tool steel workpiece, and thereafter removing the resultant metal material coating to expose the exterior of the resultant workpiece.

Advantageously, the workpiece exterior is preliminarily cleaned and roughened, for example by grit blasting, to enhance or increase the adherence of the thereafter applied metal material coating, and the metal material of said coating is suitably applied in an average thickness of about 0.006–0.010 inch, for example by metal spraying. The metal material of said coating may be any appropriate metal material such as a non-ferrous metal, and particularly aluminum.

Contemplated heatings include the usual hot working and annealing steps. The hot working step may appropriately include one or more hot rolling steps of the conventional type, such as those carried out at the hot working temperature of the tool steel, which is usually initially at least about 1800° F, and the same may be followed by conventional annealing. Removal of the resultant metal material coating and any attendant reduced decarburization in the outer peripheral portion of the workpiece may be effected by conventional cold finishing operations such as peeling and/or centerless grinding.

More particularly, the present invention concerns an overall process for heating of tool steel to form a product having a reduced decarburization outer peripheral portion, which comprises hot pressing a tool steel ingot at its hot-working temperature into billet form, cooling the resultant billet form workpiece, annealing and removing the outer peripheral portion thereof containing any surface defects, reheating the billet form workpiece to its hot working temperature and hot rolling the workpiece to reduced size billet form, cooling the reduced size billet form workpiece, annealing and removing the outer peripheral portion thereof containing any surface defects and decarburization, preliminarily cleaning and roughening the exterior of the reduced size billet form workpiece to enhance the adherence of the metal material coating to be thereafter applied, applying an adherent removable protective surface coating of metal material onto the exterior of the reduced size billet from workpiece after said preliminary cleaning and roughening, reheating the resultant metal material coated workpiece to its hot-working temperature and hot rolling the workpiece to finished size form, annealing and straightening the finished size form workpiece, and thereafter removing from the finished size form workpiece the resultant outer peripheral portion thereof containing any surface defects and decarburization and the resultant metal material coating; or after annealing and straightening the finished size form workpiece, heat treating the workpiece and then removing the resultant outer peripheral portion thereof containing any surface defects and decarburization and the resultant metal material coating.

According to one preferred embodiment of the invention, a melt conforming to the constitution of a typical high speed steel or tool steel, such as that produced in an electric arc furnace, is cast into ingots. The ingots are reheated to their hot working temperatures, between 1700° F and 2300° F in the case of high speed steel, and hot worked to a semi-finished condition. These hot working steps include in the case of rolled bar production the hot pressing or blooming on a rolling mill the heated ingot workpiece into billet form, the removal of the outer peripheral portion therefrom, e.g., by grinding or scarfing to eliminate surface defects, reheating the billet to its hot working temperature again and hot rolling, pressing or hammering to the semi-finished reduced size billet form, followed by the removal of the outer peripheral portion therefrom to eliminate surface defects and decarburization.

An adherent removable protective surface coating of aluminum is applied onto the semi-finished workpiece exterior, and the aluminum coated workpiece is reheated to its hot working temperature and hot rolled to finished size. The workpiece is then annealed and straightened on straightening rollers, and the resultant reduced decarburization outer peripheral portion and aluminum coating are thereafter removed. In order to assure increased adherence of the aluminum coating to the semifinished workpiece, the step of preliminary cleaning and roughening the exterior surface thereof is preferably included prior to the aluminizing for the final hot rolling or working operations, i.e., by which the workpiece is fabricated into its finished size for annealing.

It will be realized that the metal material coating is advantageously applied at a point in the tool steel fabrication at least as early as the production of the semi-finished size billet form workpiece. This is because the subsequent operations, involving the reheating for final rolling and the final annealing, are those heating cycles where loss of surface carbon mainly occurs. However, in its broader aspects, the present invention also contemplates applying the protective metal material coating at an earlier point such as prior to reheating for hot rolling to reduced size billet form where decarburization also occurs.

By reason of the removable nature of the protective metal material coating, and the intended further successive heating cycle hot working operations, the present invention also contemplates specific intermediate articles of manufacture. One of these is the unannealed and unstraightened semi-finished tool steel workpiece having an adherent removable protective surface coating of metal material, e.g., in the form of a metal sprayed aluminum coating in a thickness of about 0.006–0.010 inch, onto the exterior thereof, preferably with such exterior having been preliminarily cleaned and roughened prior to application of the metal material coating thereto.

The other of these is the tool steel finished workpiece having a reduced decarburization outer peripheral portion and an adherent removal protective surface coating of metal material previously applied onto the exterior of the precursor semi-finished workpiece, e.g., in an origianl thickness of about 0.006–0.010 inch, and which semi-finished workpiece has been subjected to hot working temperatures, e.g., including hot rolling at a temperature of initially at least about 1700° F to 2200° F followed by annealing and optional straightening, after the metal material coating has been applied thereto, and subjecting the workpiece to additional heat treating temperatures of initially at least 1500° F to 2350° F, whereby to form such heat treated tool steel finished workpiece. In this instance also, the exterior of the precursor semi-finished workpiece preferably has been preliminarily cleaned and roughened as stated.

The adherent protective surface coating of metal material such as aluminum may be applied onto the exterior of the tool steel workpiece by various conventional metallizing techniques, such as by metal spraying. Metallizing by aluminum spraying is used for efficient covering of the workpiece at a conveniently controllable thickness.

Generally, metal spraying involves the heating of the metal to be sprayed to molten or semi-molten condition by passage through a high temperature zone, and the depositing of the sprayed metal in a finely divided form onto the surface of the article to be sprayed. The molten or semi-molten particles of the sprayed metal flatten out on impact with the substrate surface being sprayed and adhere thereto upon freezing. Subsequently deposited particles will also flatten out and adhere in turn to those previously deposited to provide an incrementally built-up structure of sprayed deposits which is lamellar in form.

The metal to be sprayed is often supplied in wire or powder form. Thus, when metal in wire form is rendered molten, it can be subjected to a high velocity blast of air or other gas to atomize and propel it onto the substrate surface. Various metallizing guns or similar apparatus are available to spray wire, rod, or powder and they commonly utilize a mixture of oxygen and acetylene or other similar gases as the heat source. Arc spraying guns are also used whereby wire is melted in a high heat zone resulting from a D.C. Arc and the molten particles are swept off at a high velocity by compressed air.

Advantages of using the metal spraying technique to achieve the desired thickness coating are that it is not limited to any particular size of workpiece, and the available metallizing guns are handy to use.

In the case of aluminum as well as other conventionally sprayed metals, such as the non-ferrous metals: copper, bronze, lead, molybdenum, nickel, tin and zinc, and even low carbon, high carbon and stainless steels, the sprayed metal deposits resemble chemically the derivative wire, rod or powder but their physical properties are generally quite different from those of the metal before spraying. The sprayed metal deposits provide a lamellar structure which is not homogeneous and cohesion is due to mechanical bonding. Nevertheless, for the reduced decarburization protective surface coating purposes of the present invention, the metal spraying technique is quite adequate as the means for applying the desired coating layer.

To enhance the adherence of the metal material coating to the workpiece, as aforesaid, a cleaning and roughening step is preferably included. Thus, before the metal sprayed coating is applied, the surface of the workpiece is cleaned and prepared in a manner which will provide a good bonding of the sprayed metal particles to the base metal. The cleaning operation contemplates removal of grease, scale, dirt, oil and any other contaminants that would impair the bonding of the coating. Roughening of the surface of the workpiece is the final operation prior to metal spraying. Conventional mechanical roughening techniques are similarly employable to accomplish the desired purpose. As will be appreciated, both cleanness and roughness affect greatly the bond strength between the metal coating and the substrate surface of the workpiece.

An advantageous combination expedient for achieving simultaneously both cleaning and roughening of the workpiece exterior surface is the use of a conventional grit blasting step. Abrasives commonly used for preparing the surface in this respect are crushed angular sand, crushed steel grit and aluminum oxide. Steel grit or aluminum oxide is preferred since the abrasive can be readily reclaimed and reused.

The workpiece should be metallized or coated as soon as possible after the cleaning and roughening operations, in order to minimize surface oxidation and recontamination. Thus, for instance, where a part has been grit blasted and is to be metal sprayed, the workpiece may be immediately subjected to metal spraying, the relative movement of the workpiece and metallizing gun being regulated mechanically to the extent possible to insure uniformity and repeatability.

It has been found that where the surface coating being sprayed onto the workpiece exterior is built up to a thickness of between 0.006–0.010 inch over the substrate surface, a satisfactory protection is insured during heating for rolling and final annealing. Thicknesses below about 0.006 inch are generally insufficiently thin to work properly whereas those above about 0.010 inch are unnecessary. It is believed that the protection obtained during the heating cycle before rolling is due to the mechanical bonding of the applied coating to the workpiece exterior surface while the protection for annealing results from a metallurgical welding and diffusion occurring between the resultant oxides of the applied metal material coating and the substrate as a consequence of the hot working.

The protection against decarburization provided by the process of the present invention is unique in that it affords such protection not only during heating, e.g., of billets, for rolling, but also during the annealing cycle. Such protection may, if desired, continue to be effective during a subsequent heating cycle for hardening, i.e., prior to removal of the applied protective coating, such as in the manufacture of tool bits from stock rolled and annealed in the instant manner. Advantageously, ultimate protection against normal degrees of decarburization is thereby made possible during two or three consecutive and important heating cycles or working operations, by providing a metallized surface coating of the type described in accordance with the present invention.

There would not appear to be any other coating process so far known that is able to provide this degree of protection against decarburization from a single coating application. Moreover, the metallizing contemplated is particularly effective when aluminum is utilized as the specific metal material applied as the adherent temporary protective surface coating on the workpiece, since it most efficiently becomes a part of the substrate and affords more effective protection.

It will be realized that while broadly the metal material coating may be considered a coating of metal, it also contemplates the presence of some of the metal in the form of oxides. For instance, as is known, aluminum readily converts at its exposed surface to its oxide. Thus, when sprayed from a metallizing gun, the molten atomized particles will readily convert to the oxide at their periphery yet the overall result will be an aluminum-predominating metal layer fully protective of the workpiece surface as regards decarburization.

Metallizing of the billet or workpiece is satisfactory, especially considering the fact that the metal coating is thereafter subjected to repeated heating cycles and hot working operations often above its melting temperature yet below its boiling temperature. Heating and hot rolling assures flow distribution of the metallized coating and achievement thereby of a sufficiently uniform and relatively non-porous, skin, e.g., of aluminum and/or aluminum-aluminum oxide, covering over the workpiece for protection against oxidation and decarburization during annealing. This skin will provide an effective mechanical bonding initially to the workpiece substrate and as a result of the mechanical hot working operation, eventually also a metallurgical welding and diffusion.

As compared with processes involving controlled atmosphere installations to assure reduced decarburization during billet heating for hot working and/or annealing or other thermal treatments, the order of magnitude of present day investment for the same capacity is about $15,000 to $70,000 for the instant process depending on the degree of mechanization, and about $500,000 to $750,000 for either the controlled atmosphere furnace or the vacuum annealing furnace installation type process. Thus, the present invention may be practiced at a mere fraction (1/33 to 1/50) of the current cost of the conventional controlled environment production operation. It is completely surprising that despite present day trends toward relatively expensive controlled atmosphere or vacuum installations, the present invention provides a more efficient alternative at a correspondingly lower cost in terms of yield and energy.

The following examples are set forth by way of illustration and not limitation of the present invention.

In the manufacture of a 0.544 inch to 0.547 inch diameter round bar of high speed steel from a melt having the following composition:

Carbon 1.00%
Molybdenum 8.75
Tungsten 1.75
Chromium 3.75
Vanadium 2.10

The following steps are carried out to provide a semi-finished billet workpiece:

1. Melt charge in electric arc furnace
2. Cast into 12 inch ingot mold
3. Heat ingot to forging temperature of 2100° F
4. Press into 6 inch square billet or other specified size.
5. Grind to remove surface defects.
6. Reheat to specified temperature for rolling, 2080° F
7. Roll to 1⅜ inch square billet (semifinished)
8. Fully grind to remove decarburization and surface defects.

In the fabrication of the semi-finished billet workpiece into the finished 0.544 inch – 0.547 inch round bar, the following further steps are carried out under the conventional process A and separately under the invention process B:

| Conventional Process A | Invention Process B |
|---|---|
| 9A. Reheat to specified temperature, 2100° F | 9B. Grit blast to clean and roughen workpiece exterior surface, (1:1 mixture of G25 and G40) steel grit. |
| 10A. Roll to 5/8" Rd. To finish .544"/.547" Rd. | 10B. Aluminize by metal spraying to provide a protective surface coating in an average thickness of about 0.008" Wire size: 3/16" Dia. |
| 11A. Anneal | 11B. Reheat to specified temperature. |
| 12A. Straighten | 12B. Roll to 19/32" Rd. bar To finish: .544/.547" Rd. |
| 13A. Cold finish by peeling to .556/.558" and centerless grinding to .544/.547" Rd. to remove decarburization. | 13B. Anneal |
| | 14B. Straigten |
| | 15B. Cold finish by peeling to .556/.558" Rd. and centerless grinding to .544/.547" Rd. to remove from aluminum surface coating. |

The size of mold used and the pressing, heating, grinding and rolling practices may be varied according to the finished product desired and the equipment available for processing.

Based on the original melt charge, the yield of tool steel after cold finishing step 13A of the conventional process is only about 50%, whereas the yield after cold finishing step 15B of the invention process B is about 60% which tests show to be approximately the corresponding yield after straightening the bar per conventional process step 12A and before removing decarburization per step 13A. The 60% yield according to the invention after removing the aluminum surface coating per step 15B represents about a 20% increase over the corresponding 50% yield according to the conventional process and in turn about a 20% relative reduction in decarburization. Based on the melt charge, approximately 10% more usable tool steel is provided according to the invention which represents an overall savings at current costs of roughly about 8 to 15 cents per pound or 160 to 300 dollars per ton of total steel produced.

In this example, the metal spraying was carried out with an oxyacetylene gas-compressed air metallizing gun using aluminum metal wire in the conventional manner.

A cross-sectional photomicrograph (200×) of the resultant metallized 0.794 inch round rod, before removing decarburization by peeling and centerless grinding, exhibited, after a 5% Nital etch, a metallized surface layer of aluminum to a depth of 0.008 inch fully welded and diffused with and mechanically bonded to the workpiece substrate. The absence of any decarburization beneath the metallized layer could be clearly noted.

EXAMPLE 2

Example 1 is repeated except that in this case in invention process B the grit blast and aluminizing steps are performed earlier in the operation on the 6 inch square billet after grinding per step 5 and before reheating per step 6 for achieving comparable results to those of Example 1.

It will be appreciated that the foregoing specification and examples are set forth by way of illustration and not limitation. The reference to "tool steel" is for illustrative purposes only as the invention is applicable in the production of any steel in which decarburization is a problem. The invention is to be limited only by the scope of the appended claims.

What is claimed is:

1. Process of heating steel substantially protected against attendant decarburization during such heating which comprises preliminarily cleaning and roughening the steel workpiece exterior, applying an adherent removable protective surface coating of metal material onto the exterior of the steel workpiece to be heated, carrying out such heating of the thereby protected steel workpiece, said heating including at least one hot working step, and thereafter removing the resultant metal material coating.

2. Process according to claim 1 wherein the workpiece exterior is preliminarily cleaned and roughened by grit blasting or some other means to enhance the adherence of the thereafter applied metal material coating.

3. Process according to claim 1 wherein the metal material coating is applied by metal spraying.

4. Process according to claim 1 wherein the at least one hot working step is a hot rolling step.

5. Process according to claim 1 the metal material of said coating is aluminum, and the metal material coating is applied by metal spraying.

6. Process according to claim 5 wherein at least one hot working step is a hot rolling step.

7. Process according to claim 6 wherein the metal material coating is applied in an average thickness of about 0.006–0.010 inch.

8. Process for heating of steel to form a product having a reduced decarburization outer peripheral portion which comprises hot pressing a steel ingot at its hot working temperature into billet form, cooling the resultant billet form workpiece and removing the outer peripheral portion thereof containing any surface defects, reheating the billet form workpiece to its hot working temperature and hot rolling the workpiece to reduced size billet form, cooling the reduced size billet form workpiece and removing the outer peripheral portion thereof containing any surface defects and decarburization, preliminarily cleaning and roughening the exterior of the reduced size billet form workpiece to enhance the adherence of the metal material coating to be thereafter applied, applying an adherent temporary protective surface coating of metal onto the exterior of the reduced size billet form workpiece after said preliminary cleaning and roughening, reheating the resultant metal material coated workpiece to its hot working temperature and hot rolling the workpiece to finished size form, annealing and straightening the finished size form workpiece, and thereafter removing from the finished size form workpiece the resultant outer peripheral portion thereof containing any surface defects and decarburization and the resultant metal coating.

9. Process according to claim 8 wherein the removing of the outer peripheral portion from the billet form workpiece and from the reduced size billet form workpiece is carried out by grinding, the preliminary cleaning and roughening of the reduced size billet form workpiece are carried out by grit blasting, and the removing of the resultant outer peripheral portion and the resultant metal coating from the finished size form workpiece are carried out by cold finishing.

10. Process according to claim 9 wherein said hot working temperature is initially at least about 1700° F.

11. Process according to claim 10 wherein the metal material of said coating is aluminum, and the metal material coating is applied by metal spraying.

12. Process according to claim 11 wherein the metal material coating is applied in an average thickness of about −0.006 - 0.010 inch.

* * * * *